United States Patent [19]

Mills

[11] Patent Number: 4,687,249

[45] Date of Patent: Aug. 18, 1987

[54] ADJUSTABLE CANOPY FOR A WHEEL CHAIR, BEACH CHAIR, AND THE LIKE

[76] Inventor: Sharyn A. Mills, 13240 Bloomfield St., Sherman Oaks, Calif. 91423

[21] Appl. No.: 871,884

[22] Filed: Jun. 9, 1986

Related U.S. Application Data

[63] Continuation-in-part of Ser. No. 733,247, May 13, 1985, abandoned.

[51] Int. Cl.[4] ..... A47C 7/62

[52] U.S. Cl. ..... 297/184; 297/31; 297/183

[58] Field of Search ..... 297/31, 34, 183, 184, 297/374; 248/414

[56] References Cited

U.S. PATENT DOCUMENTS

| | | | |
|---|---|---|---|
| 1,262,712 | 4/1918 | Stone | 248/185 X |
| 1,758,129 | 5/1930 | Shapiro | 248/414 |
| 1,919,114 | 7/1933 | Ley | 248/414 X |
| 1,939,568 | 12/1933 | Panhorst | 297/184 X |
| 2,403,324 | 7/1946 | Anderson | 248/185 X |
| 2,561,886 | 7/1951 | Rikelman | 297/184 X |
| 3,845,985 | 11/1974 | Behrend et al. | 297/184 |
| 4,083,601 | 4/1978 | McBeth | 297/184 |
| 4,112,957 | 9/1978 | Biven | 297/184 X |

FOREIGN PATENT DOCUMENTS

| | | | |
|---|---|---|---|
| 936353 | 11/1955 | Fed. Rep. of Germany | 297/374 |
| 492959 | 4/1954 | Italy | 297/374 |

*Primary Examiner*—Kenneth J. Dorner
*Assistant Examiner*—Peter R. Brown
*Attorney, Agent, or Firm*—Keith D. Beecher

[57] ABSTRACT

An adjustable canopy for a wheel chair, beach chair and the like, which includes a tubular frame which may be turned and set to any desired angular position, and which may be coupled to a tubular back frame of the chair in frictional relationship to be slidable in the back frame so that the canopy may be set to any desired elevation.

8 Claims, 10 Drawing Figures

ADJUSTABLE CANOPY FOR A WHEEL CHAIR, BEACH CHAIR, AND THE LIKE

This application is a continuation-in-part of copending application Ser. No. 733,247 filed May 13, 1985, and now abandoned.

BACKGROUND OF THE INVENTION

Most present-day outdoor chairs require a separate umbrella on the beach to provide shade. However, the umbrella is usually awkward to carry, and it is awkward to adjust as the rays from the sum shift during the day. An object of the present invention is to provide an adjustable canopy which may be retained on or removed from the chair and folded into a compact configuration for convenient carrying, and which is constructed to be simply adjustable so that the canopy may be set to any desired height according to the desires of the user, and to any desired angle appropriately to shield the user from the sun. Moreover, the canopy may be easily adjusted during the day to maintain the desired shade for relative movement between the sun and the person.

Another object of the invention is to provide such a canopy which may be used in conjunction with wheel chairs, director's chairs, and the like.

DETAILED DESCRIPTION OF THE ILLUSTRATED EMBODIMENT

Figure 2:
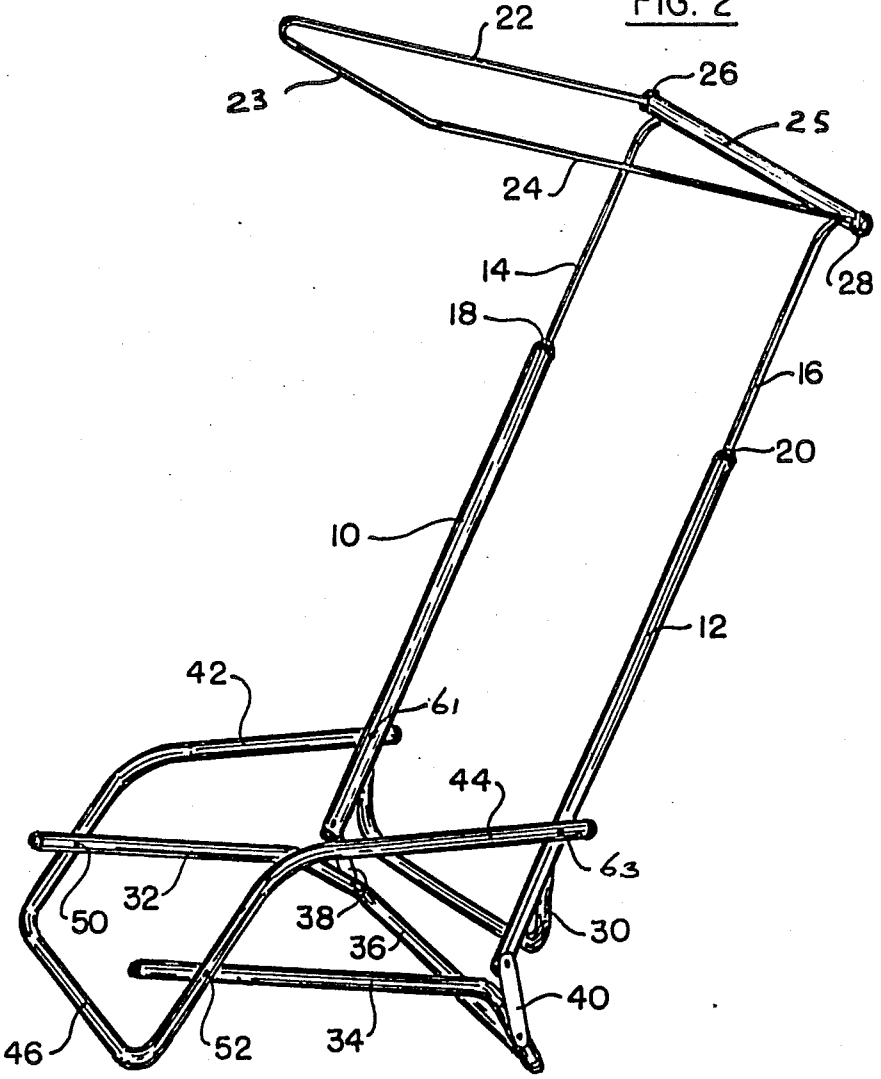
FIG. 2 is a perspective view, like FIG. 1, but with the fabric covers of the chair removed to reveal the tubular frame in greater detail.
Figure 1:
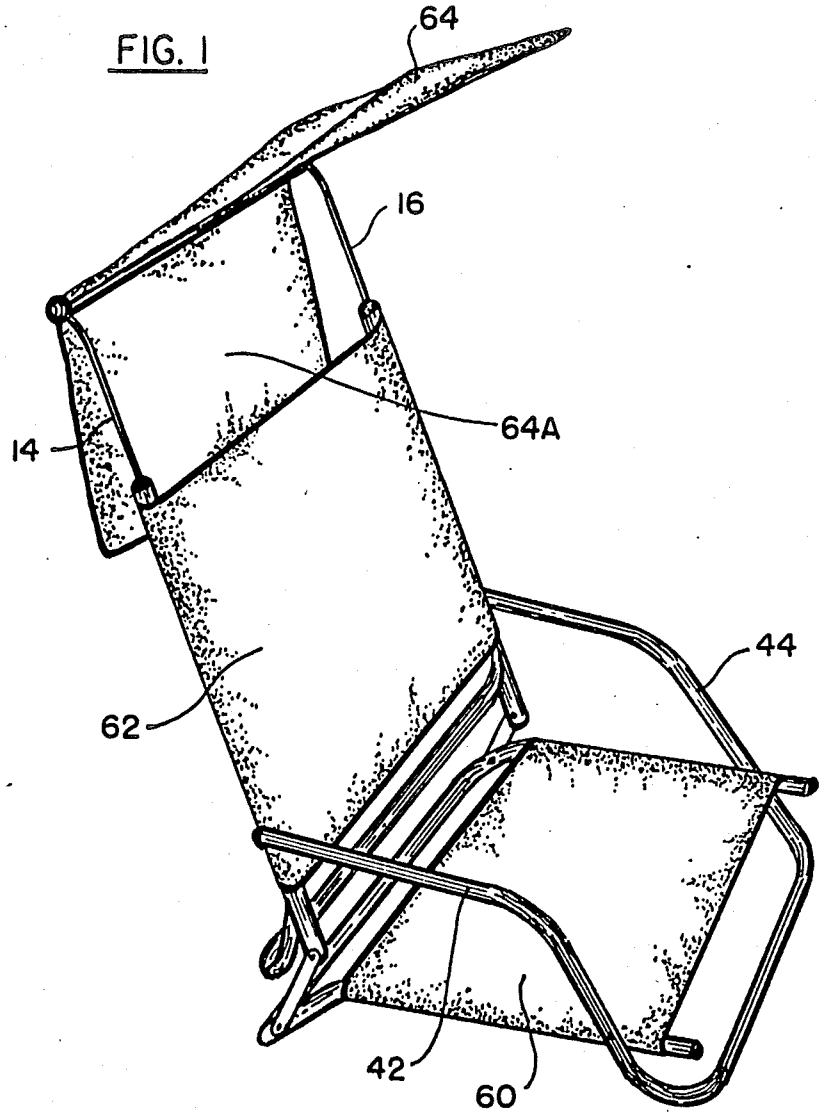
FIG. 1 is a perspective representation of one embodiment of the collapsible chair and canopy combination of the invention.

The collapsible chair and canopy combination of the invention, as more clearly shown in FIGS. 1 and 2 includes a back frame having first and second spaced and parallel elongated tubular members 10 and 12, and a slidable frame in coplanar relationship with the back frame. The frame includes first and second elongated side members 14 and 16 which are slidably received in the respective tubular side members 10 and 12 of the back frame. The side members 14 and 16 are welded or otherwise attached to a tubular cross member 25.

Frictional coupling members, which include bushings 18 and 20, are provided so that the slidable frame may be moved to any desired linear displacement with respect to the back frame, and held in that displacement by the frictional coupling members.

Figure 10:
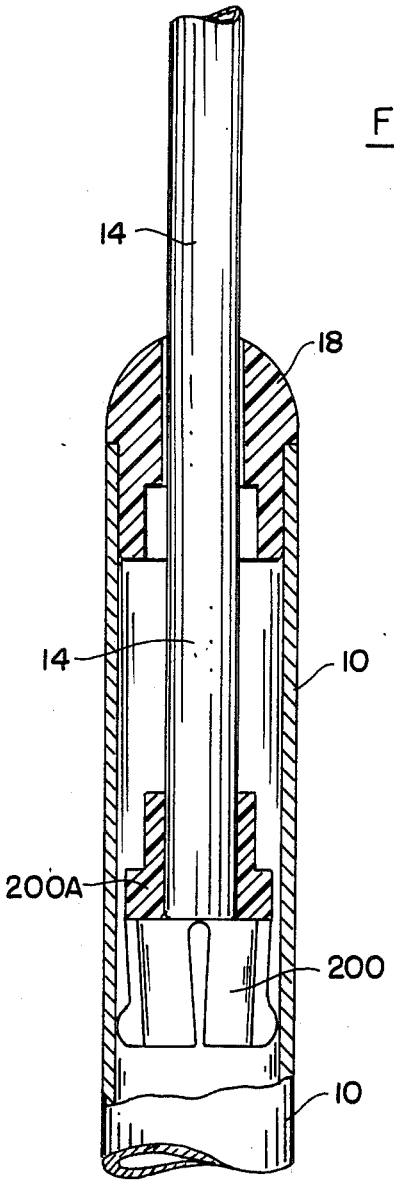

The frictional coupling members may be constructed, as shown in FIG. 10, to include a spring member 200 which slides in tubular member 10, formed of spring steel or other appropriate material. The lower portion of spring member is spring biased radially outwardly against the inner surface of tubular member 10 to create a frictional relationship. This enables side member 14 to be moved telescopically into and out of tubular member 10 so that the canopy may be set to any desired height relative to the frame. The bushing 18 is held in a press fit in tubular member 10. Spring member 200 has an upper portion 200A which extends into bushing 18 in a press fit and enables bushing 18 to be held on the end of side member 14 when the canopy is removed from the chair.

The combination also includes a canopy frame having first and second spaced and parallel elongated side members 22 and 24, and a member 23. The canopy frame is pivotally coupled to the cross member 25 of the slidable frame through frictional coupling members including threaded nuts 26 and 28, so that the canopy frame may be turned to any desired angular position with respect to the slidable frame and held in that position by the frictional coupling members.

Figure 9:
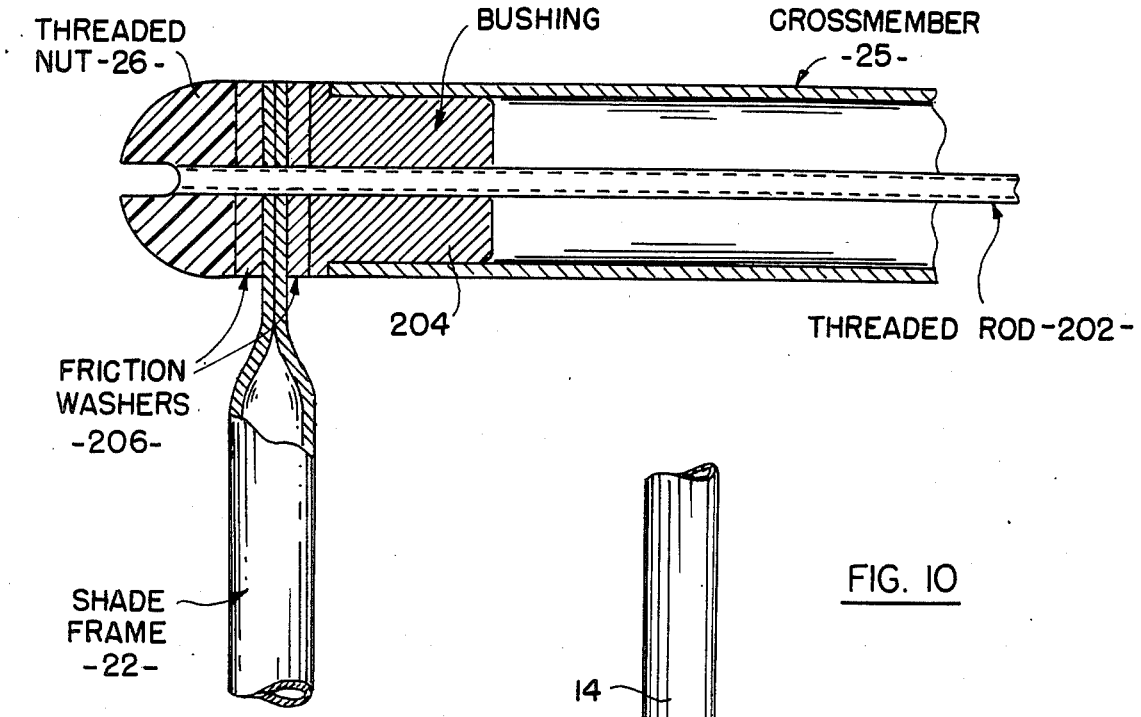
FIGS. 9 and 10 are detail sectional view of certain of the components of the canopy assembly.

The frictional coupling members, as shown in FIG. 9, include a threaded rod 202 which extends co-axially through cross-member 25 from one end to the other, a bushing 204 which fits into one end of the cross-member 25, and a similar bushing at the other end, and friction washers 206. Nut 26 is threaded to rod 202, and when the canopy has been turned to a desired angular position, nuts 26 and 28 may be tightened to hold the canopy in that position.

The back frame includes an elongate transverse member 30 extending between the lower ends of the tubular side members 10 and 12 and joined to the side members. The elongated transverse member 30 forms a reinforcing support for the back frame. Moreover, the elongated transverse member 30 is bent out from the plane of the back frame, and it functions as a convenient handle for the assembly, when the assembly is in its collapsed condition.

The collapsible chair also includes a seat frame having first and second spaced and parallel elongated side members 32 and 34, and the seat frame also includes a transverse elongated member 36 which is joined to the rear ends of the side members. The transverse member 36 is bent down from the plane of the seat frame, and it constitutes a rear support for the chair assembly. The back frame is coupled to the seat frame by linkages 38 and 40 which are pivotally coupled to the side members of the seat frame adjacent to the transverse member 36, and to the lower ends of the side members 10 and 12 of the back frame.

The chair also includes a further frame having spaced and parallel side members 42 and 44 which constitute arms. The further frame also includes a transverse elongated member 46 which is joined to the forward ends of the side members 42 and 44, and which is bent down from the plane of the further frame to constitute a front support for the chair. The rear ends of side members 42 and 44 are pivotally coupled to side members 10 and 12 by pivotal coupling members 61 and 63.

The side members 42 and 44 of the further frame are pivotally coupled to the side members 32 and 34 of the seat frame by pivotal coupling members 50 and 52.

As shown in FIG. 1, the seat frame supports a fabric seat 60, the back frame supports a fabric back 62, and the canopy frame supports a fabric canopy 64, having a back flap 64A. The fabric forming the seat, back and canopy may be formed of canvas, or other appropriate material.

Figure 4:
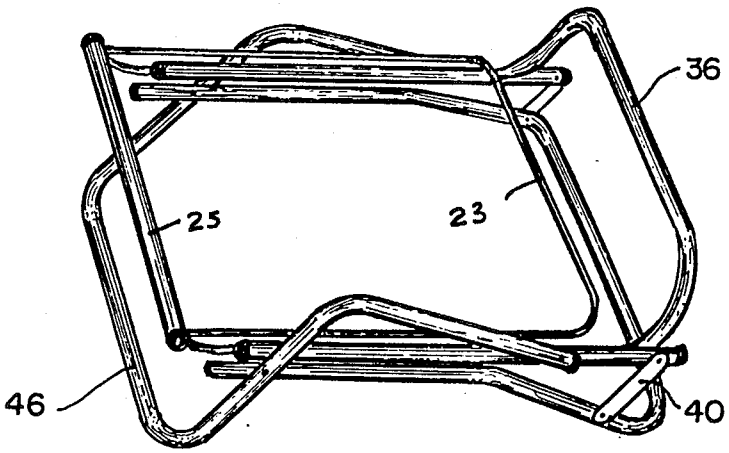
FIG. 4 shows the chair completely folded and in its carrying position.
Figure 3:
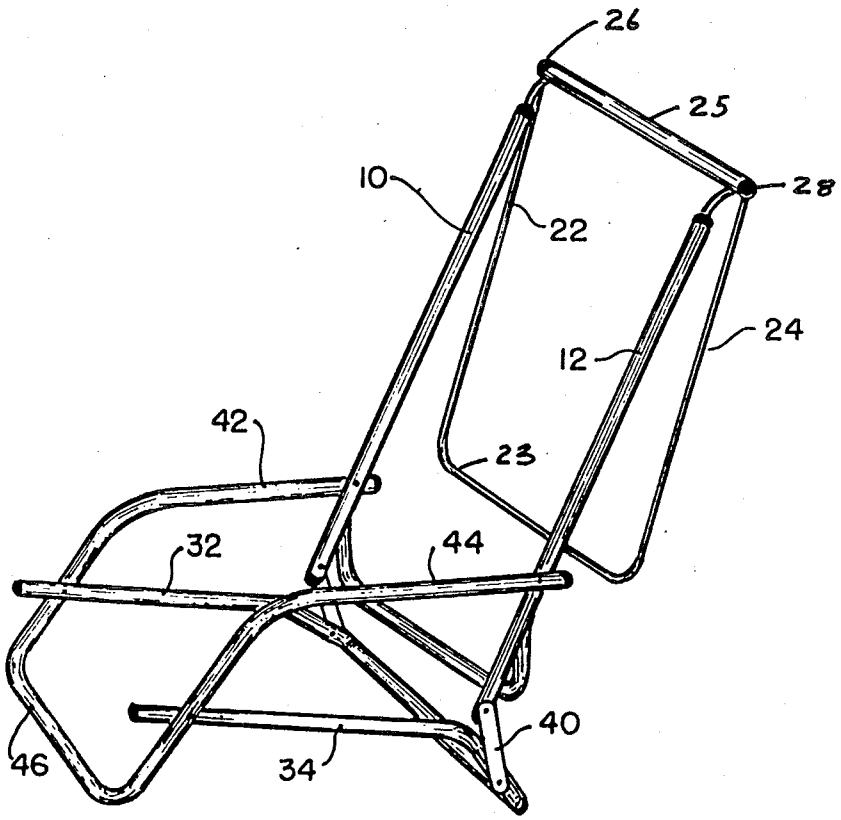
FIG. 3 is a view like FIG. 1, but with the canopy frame turned down prior to folding the chair to its carrying position.

In collapsing the chair, the first step is to turn the canopy frame back adjacent to the rear of the back frame, as shown in FIG. 3. The chair may then be collapsed by turning the back frame forwardly about the pivot points provided by the linkages 38 and 40 into the configuration shown in FIG. 4. The entire assembly may then be conveniently carried by grasping the transverse member 36.

Figure 6:
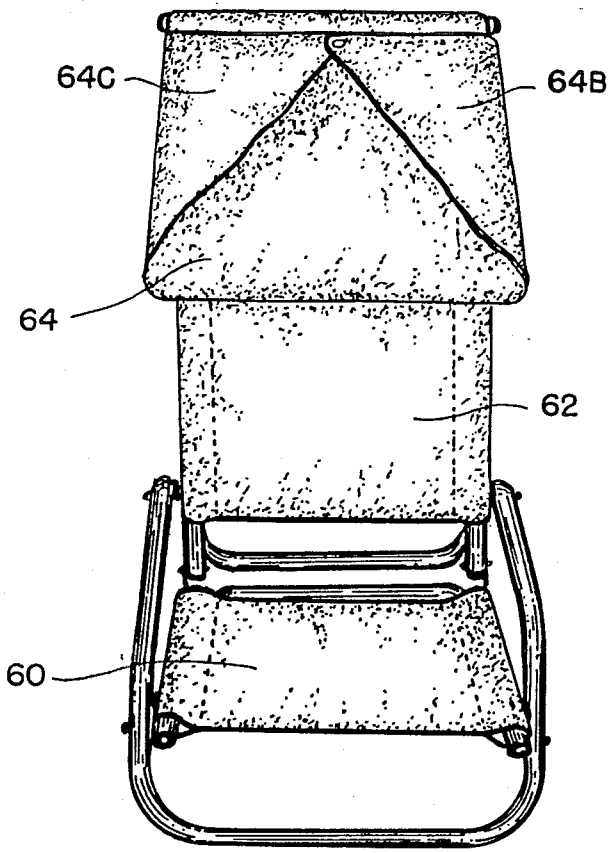
FIGS. 5 and 6 are side and front views of a modified version of the chair in which the canopy is provided with side flaps.
Figure 5:
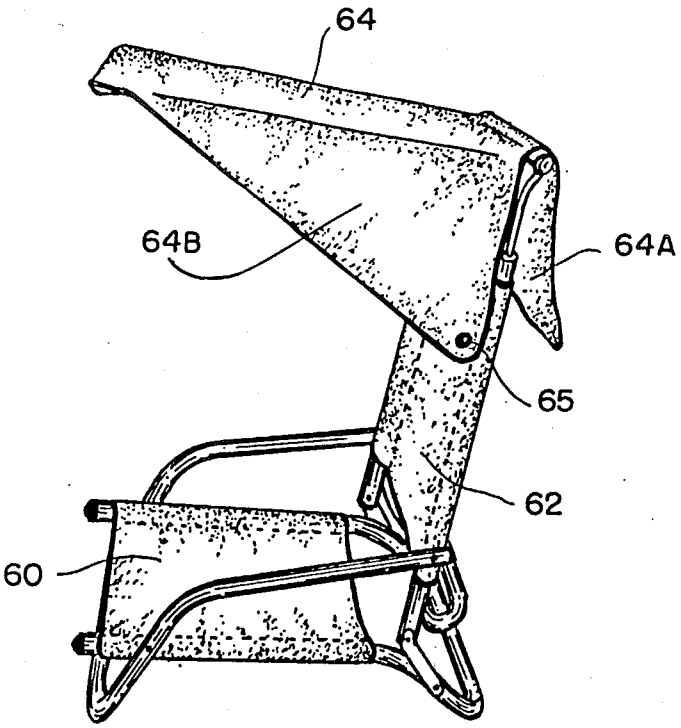

In the embodiment of FIGS. 5 and 6 the canopy is provided with side flaps 64B, 64C, to provide more complete shade for the user. When not in use, the side flaps may be folded over the top of the canopy, as shown in FIG. 6, and held in place by a Velcro fastener 65.

Figure 8:
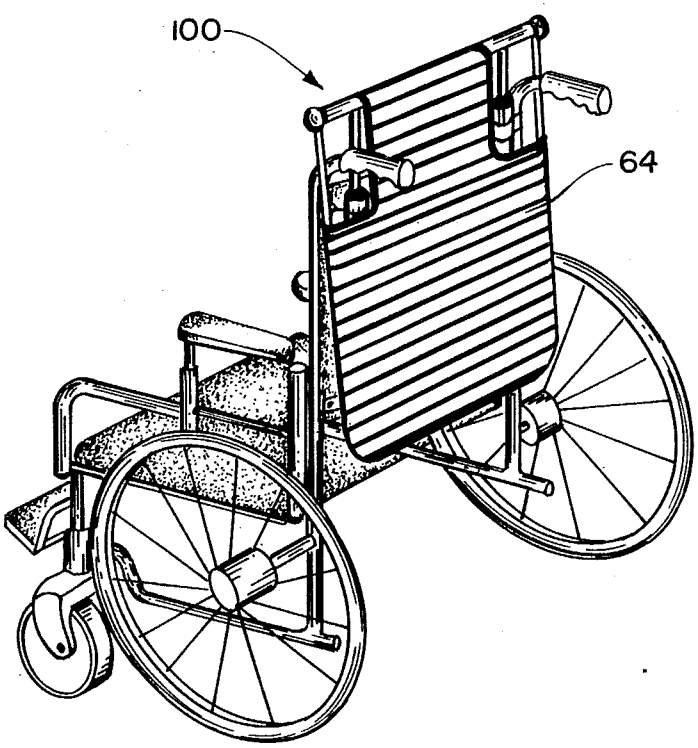
FIGS. 7 and 8 are perspective views of the canopy assembly of the invention mounted on a wheel chair.
Figure 7:
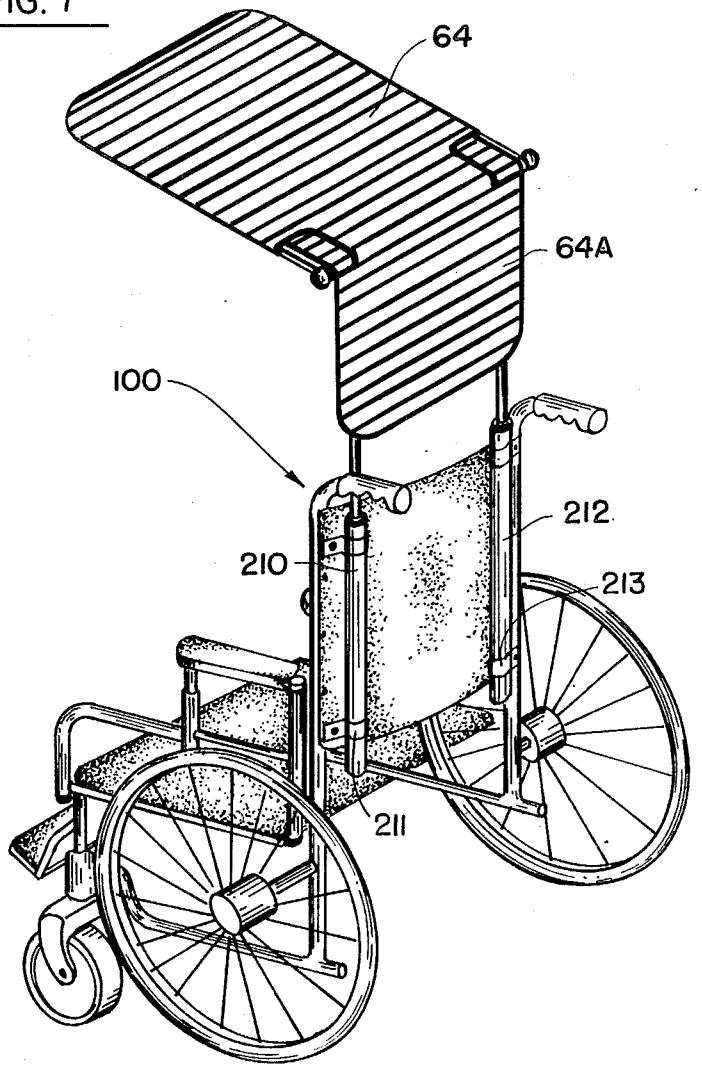

As shown in FIGS. 7 and 8, the canopy may be removably mounted on a wheel chair 100 with the side members in 916 being telescopically received in tubular members 210 and 212. The tubular members are attached to the frame of the wheel chair by appropriate straps 211, 213 or by welding, or other suitable means.

The invention provides, therefore, a simple collapsible beach chair and canopy combination which may be conveniently collapsed into a compact configuration for convenient carrying, and which incorporates a removable canopy which may be adjusted angularly and linearly with respect to the back frame of the chair to any desired position, and which is frictionally held in the position to which it is set.

It will be appreciated that while a particular embodiment of the invention has been shown and described, modifications may be made. It is intended in the claims to cover all modifications which come within the spirit and scope of the invention.

I claim:

1. A canopy assembly for a chair, said chair including a pair of spaced and parallel upright tubular side members, and said canopy assembly comprising: a U-shaped frame having first and second elongated side members and an elongated cross member at the forward end thereof; third and fourth elongated side members to be telescopically and removably received in respective ones of said tubular side members of said chair; a tubular cross member secured to the upper ends of said third and fourth elongated side members; first and second frictional coupling assemblies for respectively coupling said first and second side members of said U-shaped frame member to said tubular cross member to permit said frame to be turned and set to any desired angular position; third and fourth frictional coupling assemblies for respectively coupling said third and fourth elongated side members to said tubular side members of said chair to permit said frame to be moved linearly with respect to said tubular side members and to be set at any desired linear position with respect thereto, and to permit said frame to be removed from said tubular side members, said third and fourth frictional coupling assemblies each including a bushing mounted in press fit in the end of the corresponding one of said tubular side members of said chair for receiving the corresponding one of said third and fourth elongated side members, and a radially acting spring member mounted on the lower end of the corresponding one of said third and fourth elongated side members in frictional engagement with the inner surface of the corresponding one of said tubular side members of said chair, said spring member having a tubular upper portion to be received in press fit with said bushing when the canopy is removed from the chair to enable said bushing to be held on the end of the corresponding one of said third and fourth side members upon such removal of the canopy from the chair.

2. The canopy assembly defined in claim 1, in which said first and second frictional coupling assemblies each includes: a rod extending coaxially through said tubular cross member from one end thereof to the other, a pair of bushings extending into the respective end of said tubular cross member; and a pair of nuts threaded on the respective ends of said rod to tighten the ends of said first and second elongated side members against said bushings.

3. The canopy assembly defined in claim 1, in which said chair is a beach chair.

4. The canopy assembly defined in claim 1, in which said chair is a wheel chair.

5. The canopy assembly defined in claim 1, and which includes a fabric canopy supported on said rectangular frame.

6. The canopy assembly defined in claim 5, in which said fabric canopy includes a back flap.

7. The canopy assembly defined in claim 5, in which said fabric canopy includes a pair of side flaps.

8. The canopy assembly defined in claim 7, in which said side flaps are adaptable to be folded over the top of the canopy when not in use, and which includes fastener means for holding the side flaps in folded-over position.

* * * * *